United States Patent [19]

Hiroshima et al.

[11] 4,416,442

[45] Nov. 22, 1983

[54] METHOD AND APPARATUS FOR REMOVING SLAG

[75] Inventors: Soichi Hiroshima; Hidenao Hirasawa; Yoshinori Nakasai; Keiichi Takayama, all of Muroran, Japan

[73] Assignee: Nippon Steel Corporation, Tokyo, Japan

[21] Appl. No.: 363,771

[22] Filed: Mar. 31, 1982

[30] Foreign Application Priority Data

Apr. 10, 1981 [JP] Japan ..... 56-54198

[51] Int. Cl.[3] ..... C21B 3/04

[52] U.S. Cl. ..... 266/44; 75/24; 210/538; 210/774; 266/227; 266/239

[58] Field of Search ..... 266/227, 44, 236-238, 266/239, 201, 228; 75/24, 63; 210/774, 538, 776; 65/324; 222/591

[56] References Cited

U.S. PATENT DOCUMENTS 4,166,609 9/1979 Nagasaki et al. ..... 266/99

*Primary Examiner*—M. J. Andrews

*Attorney, Agent, or Firm*—Wenderoth, Lind & Ponack

[57] ABSTRACT

In removing slag by vacuum suction, an upward force is always applied which is greater than the force with which a suction head is attracted downward under the influence of its own weight and that of connected parts. During normal operation, a drive force is applied through a separate drive system to balance the upward force, thus keeping the suction head in the desired position. When the drive force fails, the upward force holds the suction head in the hazard-free raised position.

4 Claims, 4 Drawing Figures

METHOD AND APPARATUS FOR REMOVING SLAG

This invention relates to a method and apparatus for removing slag, and more particularly to a method and apparatus for removing, by means of vacuum suction, slag that is formed in the smelting process and floats on the top of the bath of hot metal.

BACKGROUND OF THE INVENTION

The hot metal obtained in the blast furnace or cupola contains considerable quantities of impurities such as sulfur, phosphorus and silicon. Commonly, such impurities are removed after being turned into slag in the ladle or mixer car. Methods and apparatuses that utilize vacuum suction for the removal of slag from the ladles etc. are disclosed in U.S. Pat. Nos. 3,979,108, 4,077,615, 4,160,662 and 4,166,609.

In removing slag by vacuum suction, it is necessary to keep a suction head at a level where it sucks only the floating slag, leaving the hot metal underneath unaffected. This level control is so important that it is usually accomplished by use of oil- and other fluid-based drive units.

Owing to its own weight and that of the connected parts, the suction head is always attracted downward under the influence of gravity. Thus, there has so far been the risk of the suction head dipping in the slag or hot metal when the pressure applied by the level-control drive unit falls or the drive-cylinder piping or hose breaks. Usually, the suction head sprays a large quantity of water from its tip. Entrance of this water into the slag or hot metal is very likely to cause a steam explosion that is highly detrimental to the maintenance of safety.

SUMMARY OF THE INVENTION

An object of this invention is to provide a method of removing slag in which the suction head is kept from dipping into the slag or hot metal even when the force to maintain it at a predetermined level is either lowered or lost as a result of any trouble.

Another object of this invention is to provide a slag removing apparatus having a simple structure that keeps the suction head from dipping into the slag or hot metal under any circumstances.

To achieve these ends, the method of operating the vacuum-suction slag removing apparatus according to this invention always applies to the suction head an upward force that is greater than the force with which the suction head is attracted downward because of its own weight and that of the connected parts. Then, a downward force is applied to the suction head to keep it in the desired position.

Accordingly, the suction head moves only upward, thereby avoiding the risk of plunging into the slag or hot metal, even if the force to maintain it in the given position is lowered or lost.

Thus, the vacuum-suction slag removing method according to this invention can keep the suction head from dipping in the slag or hot metal even when its level-control pressure source fails. Namely, it assures safe operation by precluding a steam explosion and other hazards that may result if such dipping occurs.

The slag removing apparatus of this invention comprises a suction head, a suction source connected to the suction head, a four-joint link device holding the suction head, a member to support from below one of the hinged joints that make up the link device, and drive means to raise and lower the supporting member. To the supporting member is coupled a load application device that always applies an upward force that is greater than the force with which the suction head is attracted downward under the influence of the weight of its own and connected parts.

This load application device keeps the suction head from dipping in the slag or hot metal even when the supporting-member elevating means fails. Furthermore, the load application device is easy to construct by use of a balance weight or spring, thereby facilitating the application of this invention to not only new but also existing equipment.

DETAILED DESCRIPTION OF THE INVENTION

Now this invention will now be described in detail by reference to the following examples of desiliconizing apparatuses in which the hot metal is molten pig iron.

Figure 1:
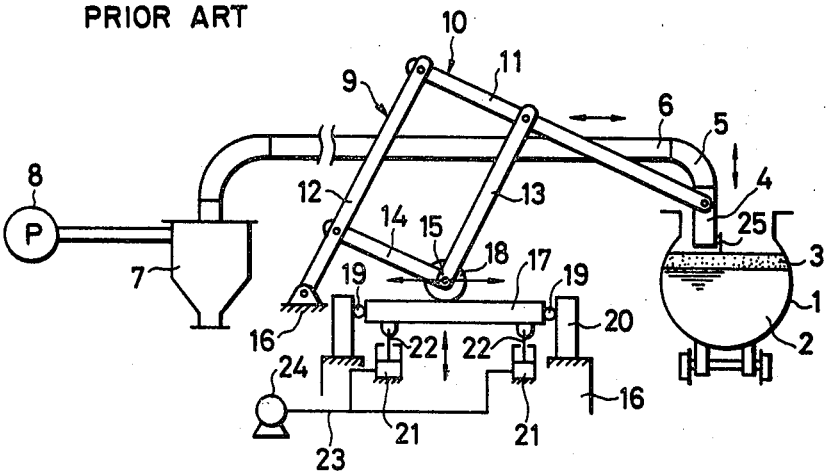
FIG. 1 PRIOR ART
FIG. 1 is an overall view of a conventional vacuum-suction slag removing apparatus.

FIG. 1 shows the overall structure of a conventional desiliconizing apparatus to which this invention is applicable. In this example, the removal of silicon from molten iron is effected in a mixer car or ladle 1. The slag 3 formed by processing floats on the surface of the molten iron 2.

A suction head 4 connects to a separator tank 7 through a flexible pipe 5 and a pipe 6. The separator tank 7 connects to a vacuum pump 8.

A suction-head holder 9 is provided by the side of the ladle 1. The suction-head holder 9 comprises a four-joint link device 10, which, in turn, comprises four links 11, 12, 13, 14, with one end of the link 11 coupled to the suction head 5. The base end of the link 12 is rotatably attached to a stand 16.

Directly under the link device 10 is provided a movable beam 17 which extends laterally (from right to left in the drawing). The movable beam 17 supports the link device 10 through a roller 18 that is rotatably attached to a hinged joint 15 of the links 13, 14. A guide roller 19 is rotatably attached to each end of the movable beam 17. The movable beam 17 is elevatably guided, by the guide rollers 19, along guide posts 20 erected on the stand 16.

To the under surface of the movable beam 17 are connected the rods 22 of hydraulic cylinders 21, to which oil is supplied under pressure from a pump 24 through a pipe 23.

A suction-head level detecting rod 25 is attached to the suction head 4. This detecting rod 25 senses the distance between the lower end of the suction head 4 and the surface of the slag 3 or molten iron 2 by means of changes in electric resistance and so on.

When the slag removing apparatus thus constructed is put in operation, the vacuum pump 8 sucks up the slag 3 through the suction head 4. The slag 3 becomes granulated by the water sprayed into the suction head 4 and reaches the separator tank 7 through the pipes 5 and 6. Here, the granulated slag is separated from steam and other gases and then taken out of the tank 7.

Figure 2:
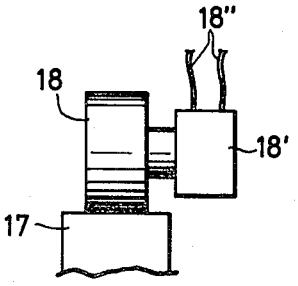
FIG. 2 PRIOR ART
FIG. 2 schematically illustrates a suction-head traverser provided in the apparatus of FIG. 1.

In sucking the slag 3, formed as a result of the desiliconization of the molten iron 2 in the ladle 1, through the suction head 4, it is necessary to exercise both vertical and horizontal control over the suction head 4 so that it is invariably held at a given height and within a given horizontal moving area above the surface of the slag 3 or molten iron 2 that changes with the progress of the sucking operation. The horizontal movement of the suction head 4 is controlled by a hydraulic motor 18' which is mounted on the roller 18 of the suction head holder 9 as shown in FIG. 2. Reference numeral 18" designates a flexible hydraulic hose that conducts hydraulic fluid to and from the hydraulic motor 18'. Roller 18 can thus move freely both vertically and horizontally. The desired control for the link device 10 is produced by the combination of the movable beam 17, cylinders 21, guide posts 20 and pump 24. The level control is exercised by balancing upward and downward forces, the upward force being applied by actuating the cylinders 21 against the force with which the suction head 4 is attracted downward under the influence of its own weight and that of the connected parts.

When the cylinders 21, pump 24 or other pressure application devices fail and the upward force stops or is reduced, the suction head 4 plunges into the slag 3 or molten iron 2 to cause the aforementioned hazards.

This invention offers a solution to this problem with the conventional slag-removing apparatuses. This invention keeps the suction head from dipping into the slag or molten iron even in the case of mechanical failure by constantly applying an upward force to the suction head that is greater than the downward force generated by the weight of the suction head and the connected parts.

Now the present invention will be further illustrated by reference to FIGS. 3 and 4, in which, for simplicity, the parts of the apparatus similar to those in FIG. 1 are omitted, and in which similar parts are designated by similar reference numerals without a detailed description thereof.

Figure 3:
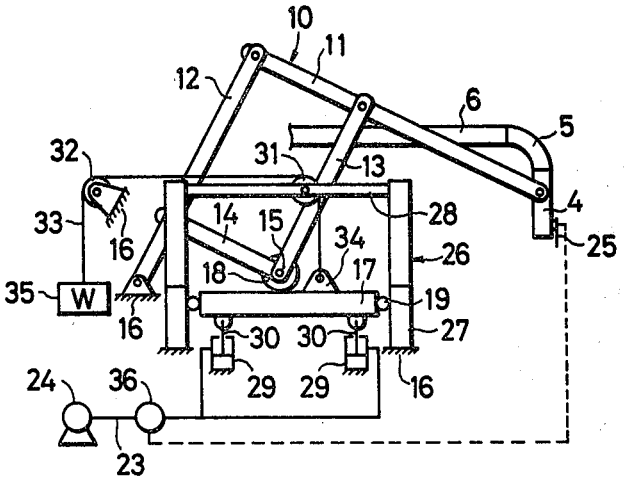
FIG. 3 is an overall view of an embodiment of the slag removing apparatus according to this invention.

FIG. 3 shows a first embodiment of this invention. As shown, a gate-like frame 26 is mounted on the stand 16. The lower part of the gate frame 26 constitutes a guide section 27 that guides the movable beam 17.

To the under side of the movable beam 17 are attached the rods 30 of hydraulic cylinders 29. Unlike the conventional ones shown in FIG. 1, the hydraulic cylinders 29 exert a force to pull the movable beam 17 down.

Pulleys 31 and 32 are provided on the horizontal beam 28 of the gate frame 26 and the stand 16, respectively. A wire rope 33 passes over the pulleys 31 and 32. One end of the wire rope 33 is connected to a bracket 34 fastened to the movable beam 17, and the other end is attached to a balance weight 35. Consequently, the balance weight 35 always exerts an upward force on the movable beam 18. The weight of the balance weight 35 is determined by taking into account the weight of the suction head 4, the members (such as the link device 10) connected thereto, and the movable beam 17. Namely, the balance weight 35 is designed to exert a force such that the suction head 4 is kept in the raised position when the hydraulic cylinder 29 applies no drive force to the movable beam 17.

While the apparatus just described is on standby, the balance weight 35 keeps the suction head 4 well above the top of the ladle 1, with the hydraulic cylinders 29 exerting no down-pulling force thereon. When removing the slag, the pump 24 supplies oil under pressure to the hydraulic cylinders 29 to lower the movable beam 17 against the force exerted by the balance weight. When the descending movable beam 17 has positioned the suction head 4 at the desired level, a signal from the detecting rod 25 actuates an electromagnetic direction-switch valve 36 to hold the suction head 4 in that position.

As the surface level of the slag 3 descends with the progress of the slag-removing operation, the detecting rod 25 detects the change and actuates the switch valve 36 to lower the suction head 4 to a suitable position. Upon completion of slag removing, the detecting rod 25 detects the surface of the molten iron 2 and emits a corresponding signal to discharge the oil under pressure from the hydraulic cylinder 29. Consequently, the balance weight 35 raises the suction head 4 to the standby position.

Even if the hydraulic cylinder 29 becomes inoperative during the slag-removing operation because of the failure of the hydraulic system, the balance weight 4 keeps the suction weight 35 in the raised position. This keeps the suction head 4 from dipping in the slag 3 or molten iron 2.

Figure 4:
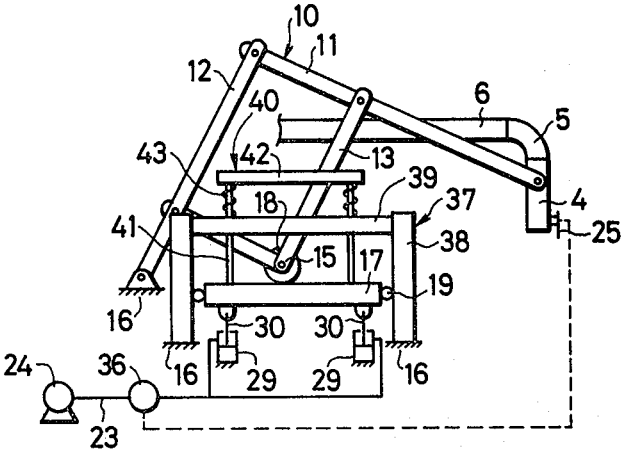
FIG. 4 is an overall view of another embodiment of the slag removing apparatus according to this invention.

FIG. 4 shows another embodiment of this invention. As seen, a gate frame 37 rests on the stand 16. The lower portion of the gate frame 37 constitutes a guide section 38 that guides the movable beam 17. A gate-shaped spring holder 40 is fastened to the movable beam 17. The pillars 41 of the spring holder 40 pass through the horizontal beam 39 of the frame 37 and carry a beam 42 fastened to the top thereof. Coil springs 43 are placed between the horizontal beams 39 and 42, coaxially with the pillars 41.

The springs 43 act to raise the movable beam 17 through the spring holder 40. The force of the springs is determined just as the weight of the balance weight 35 was determined in the preceding embodiment.

This embodiment operates in the same manner as the apparatus shown in FIG. 3 except for the means that raises the movable beam 17.

Application of the upward force to the movable beam 17 can also be achieved by other means than the balance weight 35 in FIG. 3 and the coil springs 43 in FIG. 4, such as by driving the guide roller 19 by a motor or applying hydraulic force through a system separate from the pump 24 and hydraulic cylinder 29.

What is claimed is:

1. In a method of removing slag from a body of hot metal by applying a suction from a suction head and in which the suction head is supported in the desired position relative to the surface of the hot metal by a supporting means including a linkage means and movable for moving the suction head up and down relative to the hot metal, the step of holding the suction head in the desired vertical position by applying to the supporting means a constant upward force greater than the force with which the suction head is attracted downwardly by the weight thereof and the weight of the parts connected thereto, and, at the same time, applying to said supporting means a downward force sufficient to resist said upward force for thereby holding the said supporting means and said suction head at the desired vertical position against said upward force.

2. In an apparatus for sucking up slag from a body of hot metal, the combination of a suction head, a suction source connected to said suction head, a linkage means on which said suction head is mounted for moving up and down, a support member supporting said linkage means and movable in the vertical direction for moving said linkage means up and down, a load application means coupled to said support member for applying thereto a constant upward force which is greater than the force with which the suction head is attracted downwardly by the weight thereof and the weight of the parts connected thereto, and a drive means connected to said support member for lowering the support member against the upward force applied by said load application means.

3. The combination as claimed in claim 2 in which said load application means comprises a frame means fixed relative to said support member, a pulley attached to said frame means above said support member, a wire rope extending over said pulley, one end of said wire rope being connected to said support member, and a balance weight attached to the other end of said wire rope and exerting a downward force on said other end of said wire rope for exerting said upward force on said support member.

4. The combination as claimed in claim 2 in which said load application means comprises a frame means fixed relative to said support member, a spring holder fastened to said support member, and coil spring mounted between said frame and said spring holder and urging said spring holder upwardly.

* * * * *